United States Patent [19]

Iwata et al.

[11] Patent Number: 4,747,710

[45] Date of Patent: May 31, 1988

[54] APPARATUS FOR RECEIVING A TYPE WHEEL CASSETTE IN A PRINTING APPARATUS

[75] Inventors: Nobuo Iwata, Sagamihara; Hiromi Takada, Yokohama, both of Japan

[73] Assignee: Ricoh Company, Ltd., Tokyo, Japan

[21] Appl. No.: 943,719

[22] Filed: Dec. 19, 1986

Related U.S. Application Data

[63] Continuation of Ser. No. 708,564, Mar. 6, 1985, abandoned.

[30] Foreign Application Priority Data

Mar. 9, 1984 [JP] Japan ..... 59-45078
Jun. 14, 1984 [JP] Japan ..... 59-120716

[51] Int. Cl.[4] ..... B41J 1/30

[52] U.S. Cl. ..... 400/175; 400/144.2; 400/690.4; 400/692

[58] Field of Search ..... 400/144.2, 175, 663, 400/664, 668, 690, 690.1, 690.2, 690.3, 690.4, 691, 692, 320; 369/75

[56] References Cited

U.S. PATENT DOCUMENTS

| | | | |
|---|---|---|---|
| 4,124,312 | 11/1978 | Johnson | 400/175 |
| 4,127,355 | 11/1978 | Bogert et al. | 400/175 |
| 4,142,730 | 3/1979 | Hynd et al. | 369/79 |
| 4,448,555 | 5/1984 | Hasegawa | 400/175 |

FOREIGN PATENT DOCUMENTS

| | | | |
|---|---|---|---|
| 44861 | 3/1980 | Japan | 400/171 |
| 144967 | 11/1981 | Japan | 400/171 |
| 144969 | 11/1981 | Japan | 400/175 |
| 144985 | 11/1981 | Japan | 400/54 |
| 623516 | 6/1981 | Switzerland | 400/175 |
| 2022022 | 12/1979 | United Kingdom | 400/175 |

*Primary Examiner*—David Wiecking
*Attorney, Agent, or Firm*—Oblon, Fisher, Spivak, McClelland & Maier

[57] ABSTRACT

A type wheel cassette to be loaded in a carriage of a printer, typewriter or like printing apparatus and holding a type wheel in a case thereof, and a type wheel cassette loading mechanism for removably loading the cassette in the carriage. The type wheel and the cassette can be assembled with ease, while the cassette can be readily loaded and unloaded into and out of the carriage.

6 Claims, 10 Drawing Sheets

APPARATUS FOR RECEIVING A TYPE WHEEL CASSETTE IN A PRINTING APPARATUS

CROSS REFERENCE TO RELATED APPLICATION

This application is a continuation of copending U.S. patent application Ser. No. 708,564, filed Mar. 6, 1985, now adandoned.

BACKGROUND OF THE INVENTION

The present invention relates to a printer of the type using a type wheel, or so-called daisy wheel, and constructed to select a desired type by rotating the type wheel and strike the selected wheel finger by a hammer against a platen to sequentially print out alphanumeric and other characters on a sheet, which is wrapped around the platen. More particularly, the present invention is concerned with a type wheel casette for accommodating the type wheel in a cassette case and a mechanism for removably loading the cassette in a carriage of a printer.

In a type wheel cassette of the kind described, displacement of the type wheel within the cassette case has to be restricted in order to prevent, for example, types from being damaged due to contact thereof with the cassette case when the wheel cassette is handled alone. It is another requisite that the type wheel be always held in a predetermined position inside the cassette case so that when mounted on a carriage of a printer it may be easily connected to a selection motor, which is adapted to rotate the type wheel.

The type wheel described usually includes a hub located at the center of its rotation, a plurality of fingers extending radially outwardly from the hub, and type characters provided in tip portions of the respective fingers. The hub is formed with an opening at its center and an engaging opening outwardly of the central opening. Meanwhile, the cassette case is made up of a front plate and a rear plate and receives the type wheel in a space defined between the front and rear plates. A flat retainer spring is fit on the surface of the front plate to position the type wheel inside the cassette case. The retainer spring is provided with a lug at its intermediate portion and another lug at its end portion.

In the above construction, one has to insert the type wheel into the cassette case, then put the central lug of the retainer spring in the central opening of the type wheel to position the center, and then put the other lug of the retainer spring in the engaging opening of the type wheel. Stated another way, one cannot accomplish accurate positioning of the type wheel in the cassette case merely by inserting the former into the latter, that is, without mating the opening of the type wheel and the lug of the cassette case. The assembly thus requires a troublesome procedure.

Another known approach to position the type wheel in the cassette case is disclosed in, for example, Japanese Patent Laid-Open Publication No. 55-79159. The disclosed approach consists in providing a specially configured projection on a type wheel and specially configured opening in a cassette case, instead of the interengaging openings and lugs described above. Although this approach may successfully restrict the displacement of the type wheel inside the cassette case, it also requires a troublesome assembling procedure as discussed above.

Further, in loading the cassette in the carriage of a printer or a typewriter, it is at least necessary to operatively connect the type wheel to an output shaft of a selection motor which functions to select a desired type on the type wheel and move it to a print position. In this instance, an output shaft of the motor needs to be held in a predetermined angular position before connection to the type wheel. Therefore, an exclusive motor control circuit and other circuits need be built in the body of the printer or the typewriter at the cost of the intricacy of the overall construction and arrangement.

Meanwhile, a printer or a typewriter of the kind using the above-described type wheel cassette comprises a housing which is made up of an upper cover and a lower cover. A platen, a carriage and other mechanisms are installed in the housing. The top of the housing is closed by a transparent top cover which is free to open and close. The drawback particular to such a housing structure is that a wheel cassette cannot be replaced with another unless the top cover is opened and closed each time by awkward manipulations. Besides, since the mechanical arrangements inside the printer become exposed to the outside when the top cover is opened, undesired objects may drop on them to bring about failures.

SUMMARY OF THE INVENTION

It is therefore an object of the present invention to provide a type wheel cassette used with a printer, typewriter or like printing apparatus for accommodating a type wheel therein which eliminates the drawbacks particular to the prior art approaches as discussed above.

It is another object of the present invention to provide a type wheel cassette for use with a printer, typewriter or like printing apparatus which promotes easy assembly of a type wheel and a type wheel cassette.

It is another object of the present invention to provide a type wheel cassette for use with a printer, typewriter or like printing apparatus which allows a type wheel to be accurately and easily stored in a predetermined position inside a type wheel cassette.

It is another object of the present invention to provide a type wheel cassette for use with a printer, typewriter or like printing apparatus which allows a type wheel to be readily connected to an output shaft of a selection motor and eliminates the need for special means for holding the motor in a predetermined angular position.

It is another object of the present invention to provide a type wheel cassette which allows a type wheel to be easily replaced with another without opening a top cover of a printer, typewriter or like printing apparatus.

It is another object of the present invention to provide a generally improved type wheel cassette for a printing apparatus.

In one aspect of the present invention, there is provided a type wheel cassette loading mechanism in a printing apparatus having a platen, a carriage including cassette holding means which is provided with biasing means for biasing the cassette upwardly, and a top cover covering the platen and the carriage. The type wheel loading mechanism comprises an opening in the top cover, the opening having a size sufficient to pass the cassette therethrough and being positioned on the cover such that a cassette passing therethrough may only be introduced into the cassette holding means, a lid for selectively closing the opening, and engaging means for engaging the lid with the cassette holding means such that opening of the lid moves the cassette upwardly by a biasing force of the biasing means.

In another aspect of the present invention, there is provided a type wheel cassette loading mechanism for removably loading in cassette holding means of a carriage of a printing apparatus a type wheel cassette which holds a type wheel in a case thereof. The mechanism comprises an opening formed throughout a top cover which covers the carriage of the printing apparatus, the opening being dimensioned to pass the type wheel cassette therethrough, biasing means provided in the cassette holding means for biasing the type wheel cassette upwardly, latch means for latching the type wheel cassette in a predetermined position against a biasing force of the biasing means, and releasing means for releasing the latch means. Upon release of the latch means the type wheel cassette is moved upwardly by the biasing means to become ready to be taken out through the opening.

In another aspect of the present invention, there is provided a type wheel cassette loading mechanism in a printing apparatus having a platon, a carriage including cassette holding means movable toward and away from the platen, and a top cover pivotable between a closed position covering the platen and the carriage and an open position allowing access to the platen and the carriage. The type wheel loading mechanism comprises an opening in the top cover, the opening having a size sufficient to pass the cassette therethrough and being positioned on the cover such that a cassette passing therethrough may only be introduced into the cassette holding means when the cassette holding means is moved away from the platen, a lid for selectively closing the opening, and engaging means for engaging the lid with the cassette holding means such that opening of the lid moves the cassette holding means away from the platen for permitting insertion of the cassette into the cassette holding means.

The above and other objects, features and advantages of the present invention will become apparent from the following detailed description taken with the accompanying drawings.

DESCRIPTION OF THE PREFERRED EMBODIMENT

While the type wheel cassette for a printing apparatus of the present invention is susceptible of numerous physical embodiments, depending upon the environment and requirements of use, substantial numbers of the herein shown and described embodiments have been made, tested and used, and all have performed in an eminently satisfactory manner.

To facilitate understanding of the present invention, a brief reference will be made to a prior art type wheel cassette, shown in FIGS. 1A and 1B.

Figure 1A:
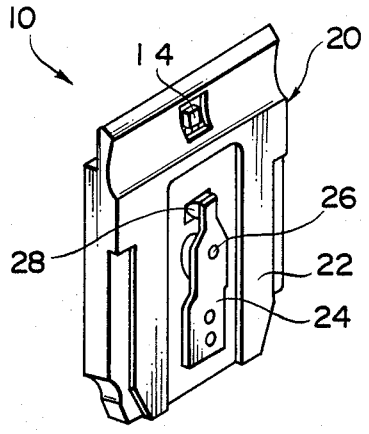
FIG. 1A PRIOR ART
FIG. 1A is a perspective view of a prior art type wheel cassette.
Figure 1B:
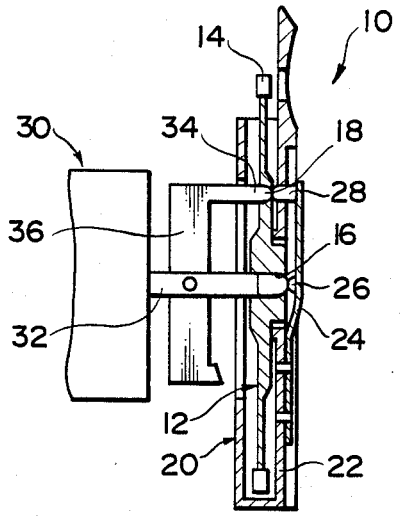
FIG. 1B PRIOR ART
FIG. 1B is a vertical section of the type wheel cassette which is connected to a selection motor.

In FIGS. 1A and 1B, the prior art type wheel cassette 10 includes a type wheel, or so-called daisy wheel, 12 having type characters 14 arranged in its peripherial portion. The type wheel 12 is provided with an opening 16 at its center and another opening 18 outwardly of the opening 16. A cassette case 20, on the other hand, includes a front plate 22 to which one end of a retainer spring 24 is fixed. The retainer spring is provided with a lug 26 at its intermediate portion and another lug 28 for engagement at its other or free end. After the type wheel 12 has been inserted in the cassette case 20, the lug 26 of the retainer spring 24 is fit in the central opening 16 of the type wheel 12 to position the center of the type wheel 12 and, then, the lug 28 is fit in the opening 18, thereby restricting the displacement of the type wheel 12 inside the cassette case 20.

The type wheel cassette 10 having the above construction is received in a cassette holder (not shown) which is installed in a carriage of a printing apparatus. A selection motor 30 for rotating the type wheel 12 is mounted on the carriage and has an output shaft 32. A connecting arm 36 provided with a pawl 34 at its tip is rigidly mounted on the motor output shaft 32. The selection motor 30 is held in advance in such an angular position that the tip of its shaft 32 aligns with the central opening 16 of the type wheel 12 and the tip of the pawl 34 with the opening 18. In this condition, when the selection motor 30 is moved toward the type wheel cassette 10, the tip of the motor shaft 32 enters the opening 16 of the type wheel 12, which is received in the cassette holder, and the pawl 34 enters the opening 18. As a result, the output shaft 32 and the pawl 34 respectively push the lugs 26 and 28 of the retainer spring 24 out of the associated openings of the type wheel 12 against the action of the spring 24, thereby constantly maintaining the type wheel 12 and the output shaft 32 in a predetermined relative angular position. This allows a desired type 14 in the peripheral portion of the type wheel 12 to be selected by rotating the motor 30.

The procedure for assembling the prior art type wheel cassette 10 is troublesome because, as described above, at least the lug 26 has to be mated with the opening 16 and the lug 28 with the opening 18 in the course of insertion of the type wheel 12 into the cassette case 20. In addition, where the cassette 10 is used, the motor output shaft 32 needs be held in a predetermined angular position before connection thereof to the type wheel 12 and such cannot be implemented without an exclusive circuit installed in the apparatus body, which would make the entire construction and arrangement intricate.

Figure 2A:
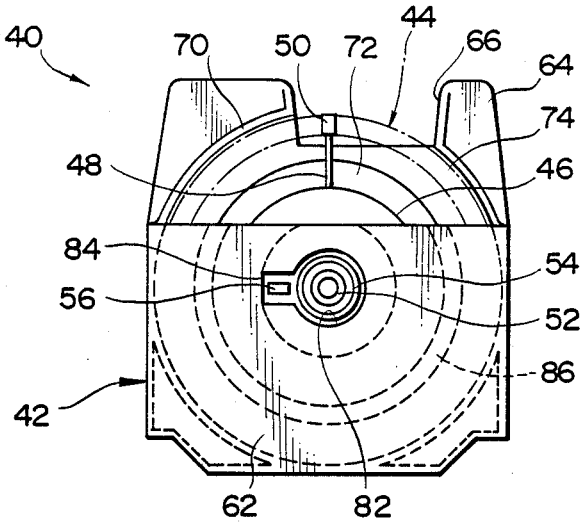
FIG. 2A is a front view of a type wheel cassette embodying the present invention.
Figure 2B:
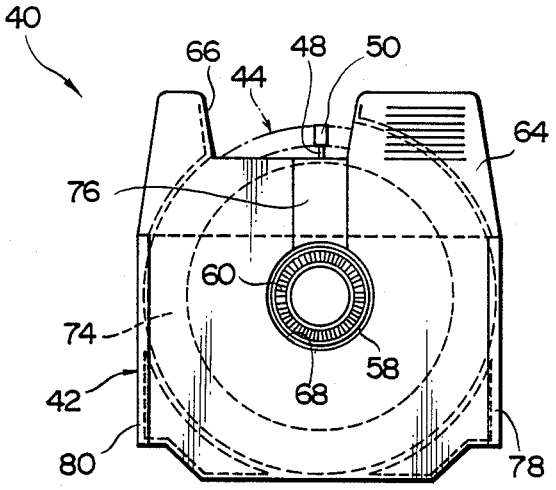
FIG. 2B is a rear view of the wheel cassette shown in FIG. 2A.
Figure 3:
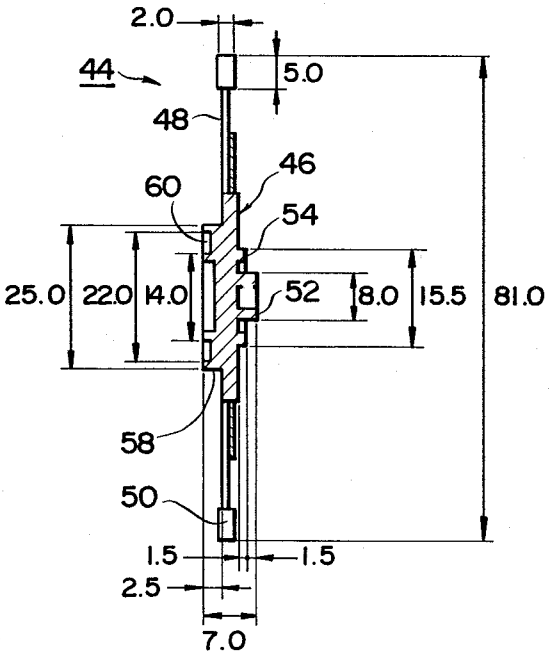
FIG. 3 is a vertical section of a type wheel applicable to the cassette of FIGS. 2A and 2B which is taken along the center of the type wheel and provided with practical dimensions.

Referring to FIGS. 2A, 2B, 3 and 4, a type wheel cassette embodying the present invention is shown and generally designated by the reference numeral 40. The type wheel cassette 40 comprises a cassette case 42 and a type wheel 44 which is accommodated in the cassette case 42. As shown in FIGS. 2A and 2B, the type wheel 44 includes a circular hub 46 located at the center, a plurality of fingers 48 extending radially outwardly from the hub 46, and type characters 50 positioned at the radially outermost ends of the respective fingers 48. Provided concentrically on the front surface of the hub 46 are a first annular lug 52 and a second annular lug 54 surrounding the first 52. A home position mark 56 is positioned on the hub 46 outwardly of the annular lug 54. On the rear surface, the hub 46 is provided with an annular lug 58 located at the center and crown teeth 60 formed at the top of the lug 58. The fingers 48 extending from such a hub 46 may be made of nylon which contains glass fibers, while the type characters 50 located at the tips of the fingers 48 may be made of phenol resin which also contains glass fibers. The various portions of the type wheel 44 may be dimensioned as shown in FIG. 3 by way of example (in millimeter).

Figure 4:
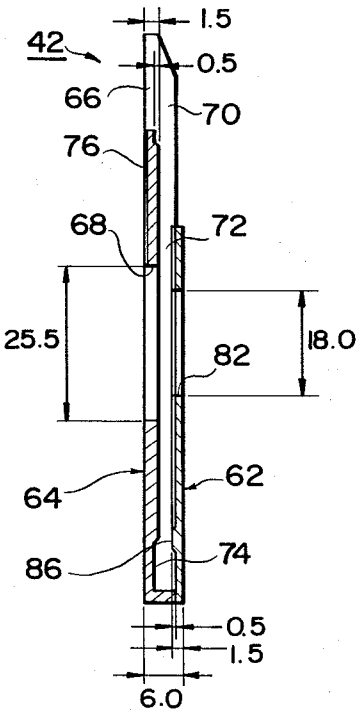
FIG. 4 is a vertical section of a cassette case applicable to the cassette of FIGS. 2A and 2B which is taken along the center of the cassette case and provided with exemplary dimensions.

The cassette case 42, on the other hand, comprises a front plate 62 and a rear plate 64 each being made of, for example, transparent AS resin. As shown in FIGS. 2A and 2B, the rear plate 64 is provided with a notch 66 at its upper end and a circular opening 68 at its center. On the front face, the rear plate 64 is provided with an annular frame 70 to define a space 72 for accommodating the type wheel 44. The front face of the rear plate 64 is sunk along the periphery of the space 72 to form an annular recess 74. On the rear face of the rear plate 64, a recess or groove 76 is formed spanning the notch 66 and the circular opening 68 in order to accommodate a hammer, which will be described. The rear face is chamfered at opposite sides thereof to provide slants 78 and 80. The front plate 62 is fit on the front side of the rear plate 64 which is configured as described above. The front plate 62 covers about lower two-thirds of the rear plate 64 while being left open in its upper portion. The front plate 62 is formed with a circular opening 82 in alignment with the opening 68 of the rear plate 64, the opening 82 being slightly smaller in diameter than the opening 64. The opening 82 communicates to a rectangular window 84 which is adapted for sensing the previously mentioned home position mark 56. Provided on the rear face of the front plate 62 is an annular ridge 86 with which fingers 48 of the type wheel 44 are engageable. Exemplary dimensions of the various parts of the cassette case 42 are shown in FIG. 4 (in millimeter).

When the type wheel 44 is inserted into the cassette case 42, the annular lug 58 fits in the circular opening 68 and the annular lug 54 in the circular opening 82 each with some looseness. The type wheel 44 is retained in the cassette case 42 with the outer peripheries of the lugs 58 and 54 engaged with the inner peripheries of the openings 68 and 82, respectively. In this condition, the fingers 48 of the type wheel 44 individually abut against the annular ridge 86 of the cassette case 42, so that the front faces of the type characters 50 may be prevented from making contact with the rear surface of the front plate 62. The annular recess 74 of the rear plate 64, on the other hand, prevents the rear faces of the type characters 50 from making contact with the front surface of the rear plate 64.

Figure 5:
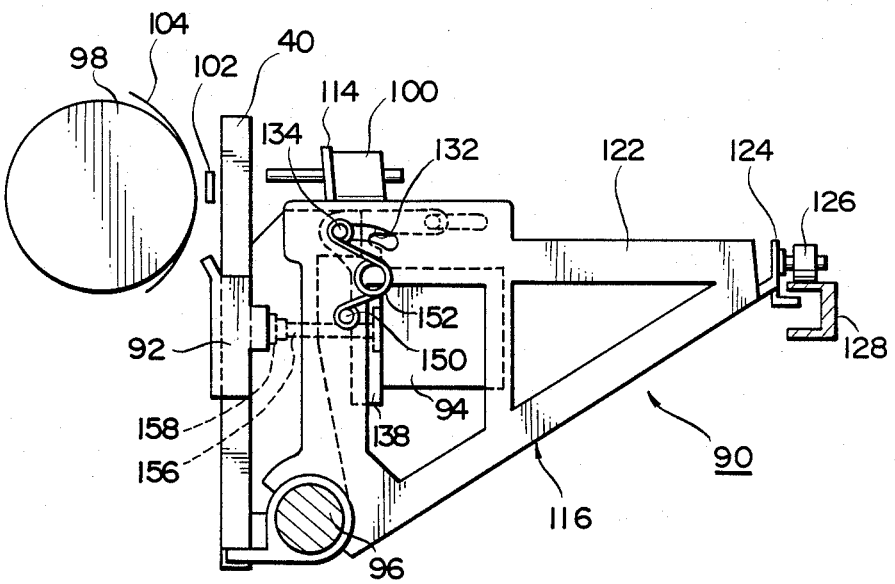
FIG. 5 is a fragmentary view of a printing apparatus including a carriage, on which the cassette of FIGS. 2A and 2B is mounted, a platen and others, and shown in a printing condition.

As shown in FIG. 5, the wheel cassette 40 in accordance with the illustrative embodiment is supported by a holder frame 92 which is included in a carriage 90 of a printer or a typewriter. A selection motor 94 is drivably connected to the type wheel 44. As well known in the art, the carriage 90 is movable along a platen 98 guided by a support shaft 96. While the carriage 90 is so moved, desired types on the type wheel 44 are sequentially selected by the selection motor 94. A hammer 100 is provided for striking the selected type characters one by one against the platen 98 through an ink ribbon 102, thereby sequentially printing out characters on a sheet 104 which is wrapped around the platen 98.

Figure 7:
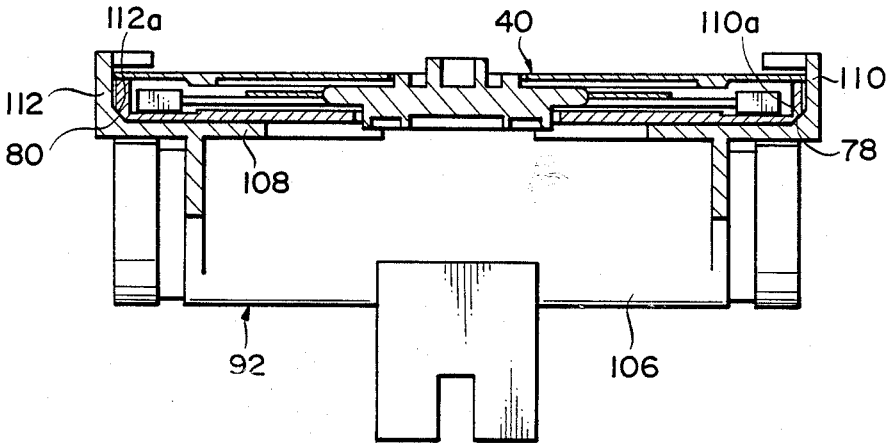
FIG. 7 is a horizontal section of a holder frame on which the cassette of FIGS. 2A and 2B is mounted.
Figure 6:
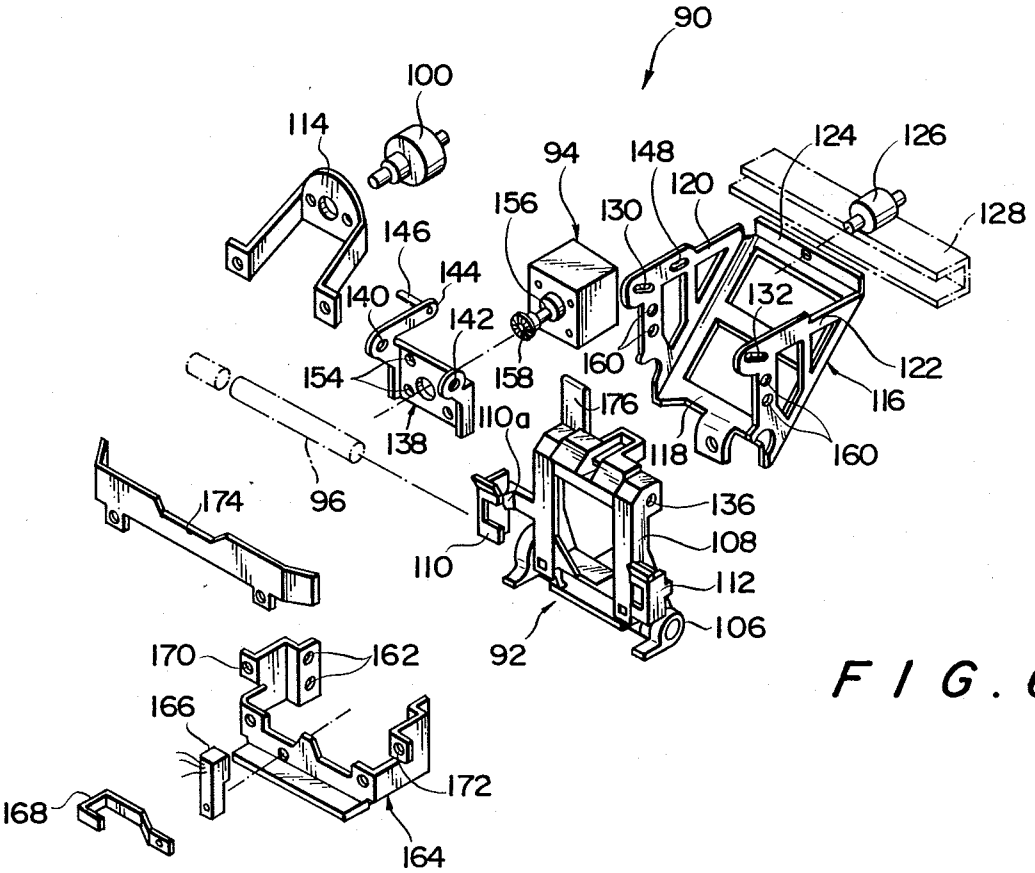
FIG. 6 is an exploded perspective view of the carriage shown in FIG. 5.

The holder frame 92, as shown in FIG. 6, comprises a tubular bearing portion 106 through which the support shaft 96 extends, a generally rectangular frame portion 108 rising from the bearing portion 106, and a pair of holder arms 110 and 112 located in front of and at opposite sides of the frame portion 108 for holding the type wheel cassette 40. As shown in FIG. 7, the holder arms 110 and 112 respectively are provided with slants 110*a* and 112*a* at their inner sides. The slants 110*a* and 112*a* serve to allow the cassette 40 to be adequately inserted into the holder arms 110 and 112 in cooperation with the slants 78 and 80 of the cassette case 42; if the cassette 40 is positioned with its front and rear faces reversed, the slants 110*a* and 112*a* will obstruct the insertion of the cassette 40 into the holder arms 110 and 112.

A hammer bracket 114 is fastened to an upper portion of the frame portion 108 of the holder frame 92. The hammer 100 is rigidly connected to the hammer bracket 114 to hit against the rear face of a selected type character 50 of the type wheel through the notch 66, the type wheel 44 being mounted on the carriage as previously described.

A carrier frame 116 rests on the bearing portion 106 of the holder frame 92 at its lower front end. The carrier frame 116 is made up of a bottom frame 118, a pair of side frames 120 and 122 rising from both sides of the bottom frame 118 to a height which sequentially decreases toward the rear end, and a rear frame 124 rising from the rear end of the bottom frame 118. A roller 126 is rotatably mounted to the rear frame 124 and laid on a support stay 128 to roll thereon, the support stay 128 extending parallel to the platen 98. In this construction, the carriage 90 is supported by the support shaft 96 and support stay 128 and movable along the platen 98.

The side frames 120 and 122 of the carrier frame 116 respectively are provided with arcuate slots 130 and 132 at their upper front portions. Each of the arcuate slots 130 and 132 forms part of a circle whose center is aligned with the axis of the support shaft 96. A connecting shaft 134 extends through the arcuate slots 130 and 132, aligned through bores 136 provided in the upper end of the frame portion 108 of the holder frame 92, and openings 140 and 142 formed through opposite sides of a motor bracket 138. An arm 144 extends rearwardly of one side of the motor bracket 138, while a pin 146 extends sideways from the free end of the arm 144. The pin 146 is received in a horizontally extending linear slot 148 which is formed through one side frame 120 of the carrier frame 116 and at a small rearward spacing from the arcuate slot 130. Thus, the motor bracket 138 is suspended from the carrier frame 116 by the connecting shaft 134 and pin 146 and movable in a direction perpendicular to the platen 98 guided by the arcuate slots 130 and 132 and the slot 148.

Figure 8:
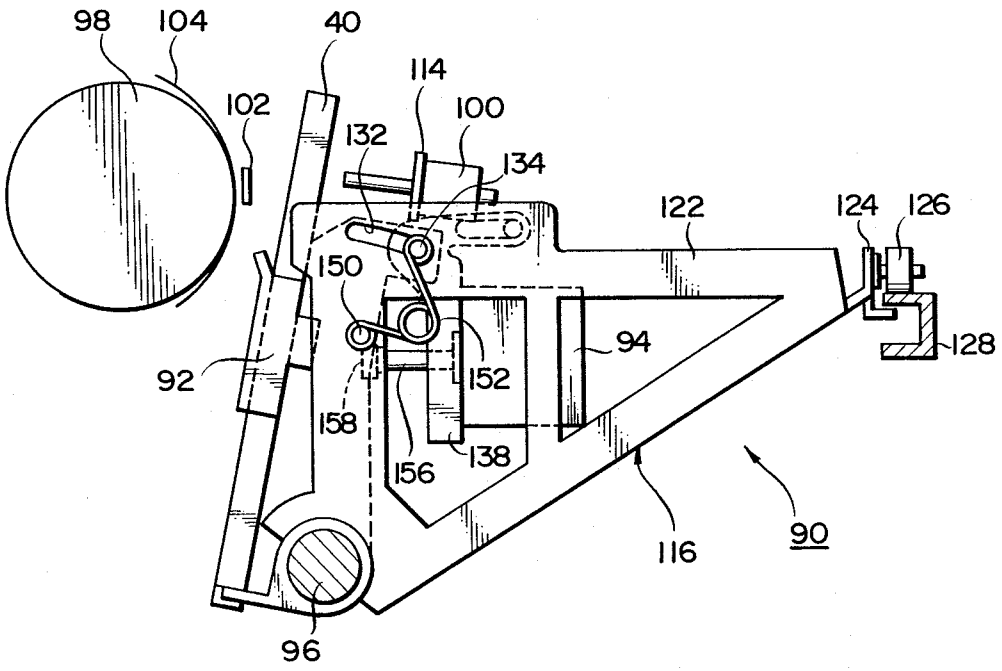
FIG. 8 is a view similar to FIG. 5 but showing the printing apparatus in a cassette replacing condition.

Meanwhile, as shown in FIG. 5, a toggle spring 152 is anchored at one end to a pin 150 extending from the carrier frame 116 and at the other end to one end of the connecting shaft 134. Although invisible in FIG. 5, another toggle spring is associated in the same manner with the other end of the shaft 134. The toggle springs 152 will urge the motor bracket 138 against the front ends or the rear ends of the slots 130, 132 and 148; FIG. 5 shows the motor bracket 138 abutting against the front ends and FIG. 8 shows it abutting against the rear ends.

The selection motor 94 is fastened to the motor bracket 138 by means of screws (not shown) which are passed through openings 154 of the motor bracket 138. An output shaft 156 of the motor 94 extends through the motor bracket 138, while a crown gear 158 is rigidly mounted on the tip of the motor output shaft 156. The crown gear 158 has a tooth width of 3 millimeters. When the motor bracket 138 is in its forward position, the crown gear 158 is urged by the toggle spring 152 to mesh with the previously mentioned crown teeth 60 of the type wheel 44. As shown in FIG. 3, the crown teeth 60 has a tooth width of 4 millimeters.

As shown in FIG. 6, the side frames 120 and 122 of the carrier frame 116 are each formed with two openings 160. A front frame 164 is mounted to the side frames 120 and 122 with openings 162 thereof aligned with the openings 160. A sensor 166 responsive to the home position mark 56 is secured to the front end of the front frame 164 in order to determine the home position of the type wheel 44. Also fixed to the front end of the front frame 164 is a leaf spring 168 adapted to rearwardly bias the type wheel in the cassette case 42, so that the crown teeth 60 may surely mesh with the crown gear 158. A cassette holder 174 is fastened to the front frame 164 using openings 170 and 172 which are provided in opposite sides of the front frame 164.

While the output shaft 156 of the selection motor 94 is coupled with the type wheel 44, the type wheel 44 can be rotated to select a desired type and, then, the selected type can be struck by the hammer 100 to print out a character on the sheet 104.

To replace the type wheel 44 in the condition shown in FIG. 5, a knob 176 rising from the holder frame 92 is held by fingers to move the holder frame 92 rearwardly about the support shaft 96 against the action of the toggle spring 152, thereby rearwardly moving the motor bracket 138 which is suspended from the connecting shaft 134 of the holder frame 92 rearwardly. Then, due to the leverage between the distance from the shaft 96 to the crown teeth 60 and that between the shaft 96 to the shaft 134, the crown gear 158 is released from the crown teeth 60. The toggle springs 152 in turn urge the shaft 134 and pin 146 against the rear ends of the slots 130, 132 and 148, as shown in FIG. 8. This causes the holder frame 92 to tilt rearwardly about the shaft 96, so that the upper end of the holder frame 92 moves away from the platen 98 to facilitate replacement of the cassette 40.

While the holder frame 92 has been shown and described as being movable about the support shaft 96, it may alternatively be arranged to move about a shaft which is mounted on the carrier frame 116, for example. The critical feature is that it is movable on the carrier about its lower end.

In the illustrative embodiment, the motor bracket 138 serving as a motor support member is movable along the arcuate slots 130 and 132 and slot 148 formed through the carrier frame 116. Such is not restrictive, however. For example, the motor support member may be arranged to be guided by guide rails or the like, instead of the slots, while the slots 148 and the pin 146 may be replaced with projections provided on the carrier frame and openings provided in the motor bracket 138 for receiving the projections.

As previously described, the cassette case 42 is provided with the recess 76 at its rear surface so that when the cassette 40 is manipulated into the holder frame 92, the cassette 40 may be prevented from making contact with the hammer 100.

It will be seen that in accordance with the illustrative embodiment insertion of a type wheel cassette into a printing apparatus is attainable without coupling a type wheel with a cassette case in a specific angular position and, instead, by simply inserting the former into the latter. In addition, since a selection motor and the type wheel achieves and operative connection with no regard to their angular positions, it is not necessary to move an output shaft of the selection motor to a specific angular position before the connection and, therefore, the need for an exclusive circuit for so positioning the motor output shaft is eliminated.

Hereinafter will be described a mechanism for loading a type wheel cassette of the kind described in a typewriter, printer or like printing apparatus in accordance with the present invention, particularly a wheel cassette loading mechanism which allows a type wheel cassette to be removably loaded and replaced automatically, that is, without opening or closing a top cover of the printing apparatus.

Figure 9A:
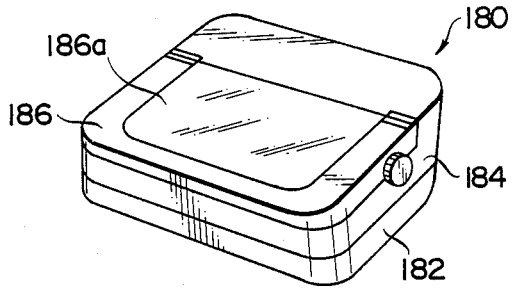
FIG. 9A PRIOR ART
FIGS. 9A and 9B are views of a prior art serial impact printer.
Figure 9B:
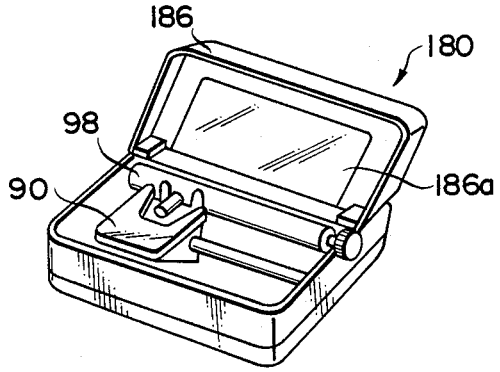
FIG. 9B PRIOR ART

Referring to FIGS. 9A and 9B, a prior art serial impact printer 180 is shown as an example of printing apparatuses of the kind using such a type wheel cassette as one described hereinabove. The printer 180 is accommodated in a casing which is made up of a lower cover 182, an upper cover 184, and a top cover 186. The top cover 186, which extends over the length of the platen 98 and the movable range of the carriage 90, is pivotally mounted along its rearmost edge in order to be openable to faciliate inspection and maintenance of the platen 98, carriage 90, etc. Further, a part of the top cover 186 other than the edge portions comprises a transparent cover **186*a*** which allows one to see the printing conditions from outside the printer.

To replace the type wheel cassette 40 with another, as shown in FIG. 9B, one has to open the top cover 186, then pull the cassette 40 upwardly out of the printer 180, and then load another cassette. Such manipulations have already been discussed with reference to FIGS. 5 and 8 and, therefore, will not be described any further for simplicity. When the top cover 186 is opened, a cover open switch (not shown) will be actuated to turn off the power for enhancing safe replacement.

As previously mentioned, the prior art serial printer 180 requires opening and closing the top cover 186 every time one intends to replace the wheel cassette 40. Moreover, while the top cover 186 is open, the mechanical arrangements inside the printer 180 are unnecessarily exposed to the outside and, therefore, apt to fail due to entry of unwanted objects into the printer 180.

An embodiment of the present invention which constitutes a solution to the above problems will be described with reference to FIGS. 10–15. In these drawings, the same or similar structural elements as those of the previously described embodiment are designated by like reference numerals.

Figure 10:
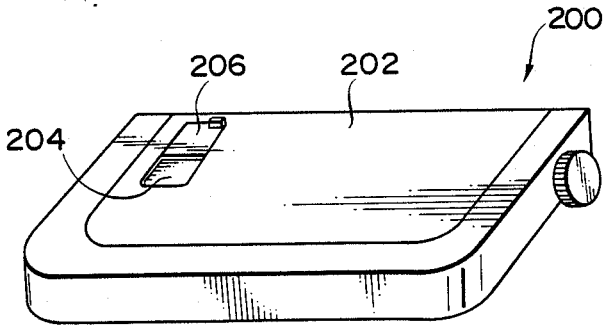
FIG. 10 is a perspective view of a top cover of a printer to which the present invention is applicable.
Figure 11:
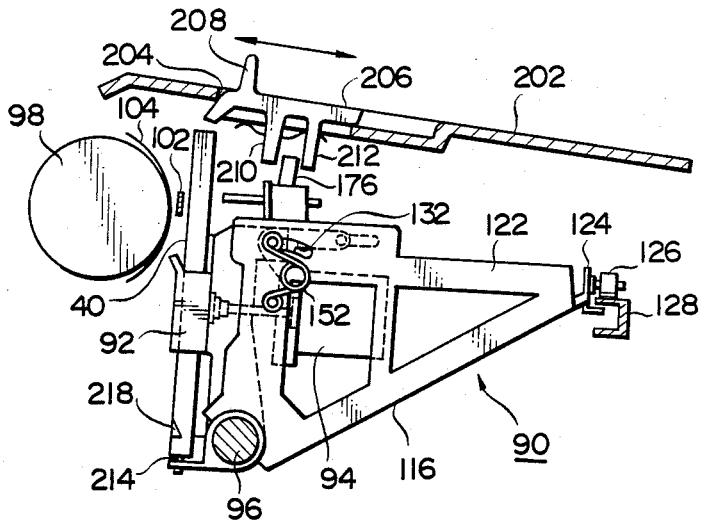
FIG. 11 is a side elevation of a carriage and a top cover of the printer of FIG. 10, the top cover being partly shown in a section.

Referring to FIGS. 10 and 11, a top cover 200 in the illustrative embodiment includes a transparent portion 202 which is provided with a small window 204. The window 204 is positioned to align with the carriage 90 which is in the home position, for example, and is so dimensioned as to accommodate the cassette 40. The window 204 is covered with an openable lid which is provided as a slidable lid 206 in the illustrative embodiment. As shown in FIG. 11, the slidable lid, or slider, 206 is provided with a knob 208 on its upper surface and an engaging portion on its lower surface. In this particular embodiment, the engaging portion comprises two spaced lugs 210 and 212. Meanwhile, an engaging portion coactive with that of the slider 206 is provided on the top of the hollow frame 92 and, in this embodiment, comprised of an operating piece 176 which is movable into the space between the lugs 210 and 212.

Figure 12:
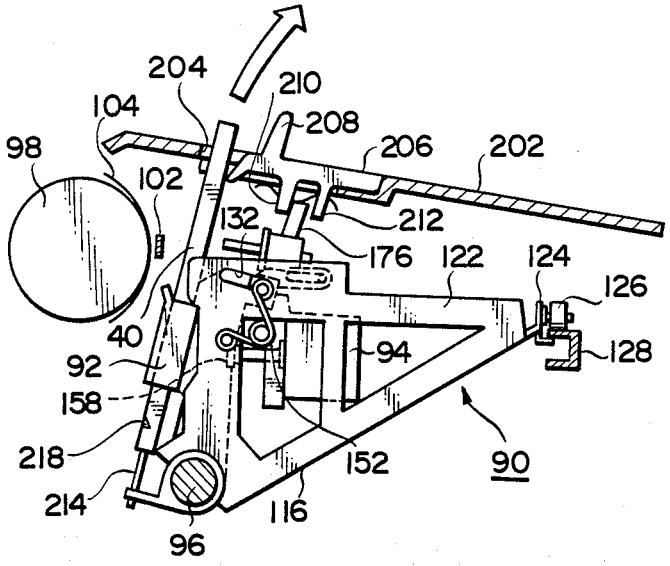
FIG. 12 is a side elevation of the printer of FIG. 10 shown in a cassette unloading condition.
Figure 13:
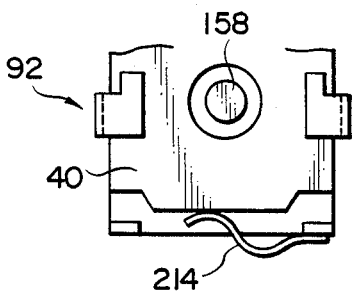
FIG. 13 is a side schematic front view of a cassette holding section of a carriage.
Figure 14:
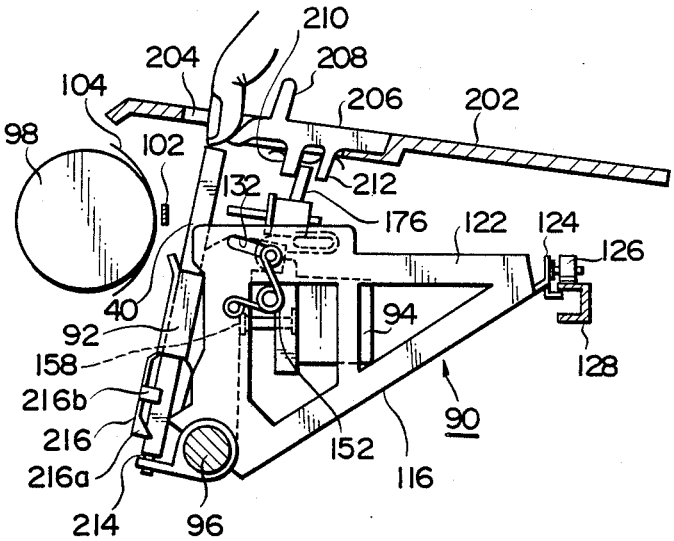
FIG. 14 is a side elevation of the printer of FIG. 10 shown in a cassette loading condition.
Figure 15A:
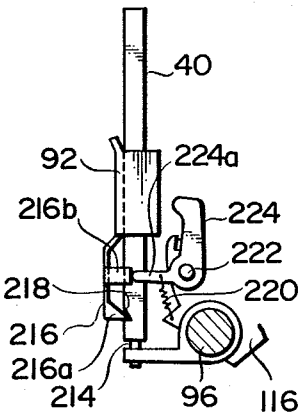
FIGS. 15A–15C are side elevations showing the operation of a cassette locking member.
Figure 15B:
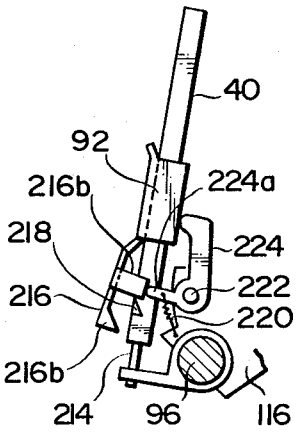

As shown in FIG. 13, a leaf spring 214 is associated with the holder frame 96 as a spring for upwardly biasing the lower end of the cassette 40 which is mounted on the carriage 90. Although not shown for clarity in FIGS. 11 and 12, the cassette holding portion of the holder frame 96 is provided with a locking member. As shown in FIGS. 14 and 15A–15C, the locking member in the illustrative embodiment comprises a latch pawl 216 formed of a leaf spring. As shown in FIG. 15A, while the cassette 40 is kept in a predetermined loading position, a pawl **216*a* at the lower end of the latch pawl 216 is engaged in a notch 218 which is formed in the cassette 40 to align with the pawl 216*a*, thereby locking the cassette 40 in the loaded or operative position against the action of the leaf spring 214. A lug 216*b* protrudes rightward as viewed in the drawings from an intermediate portion of the latch pawl 216. A generally L-shaped stop pawl 224 (not shown in any of FIGS. 11–14) is constantly biased by a tension spring 220 counterclockwise about a point 222 on the carrier frame 116 and is engagable with the tip of the lug 216*b* at one end thereof, i.e. arm 224*a*. The other end of the stop pawl 224 faces the cassette holding portion of the holder frame 96 at a narrow spacing therefrom. The stop pawl 224 provides a linkage for actuating the latch pawl 216** as will be described, although the same purpose may be achieved by use of a linkage other than the stop pawl.

The procedure for replacing the type wheel cassette 40 in accordance with the above embodiment will be described.

When the carriage 90 is moved to a position just below the window 204, e.g. home position, the operating piece 176 on the carriage 90 comes to intervene between the two lugs 210 and 212 of the slider 206. In this condition, as the knob 208 on the top of the slider 206 is manually pulled from the position shown in FIG. 11 to one shown in FIG. 12 to open the window 204, the piece 176 is pushed by the lug 210 rightwardly as viewed in FIG. 12. As a result, the cassette 40 is caused to tilt such that its upper portion moves away from the platen 98 and, at the same time, the type wheel 44 is uncoupled from the selection motor 94.

Figure 15C:
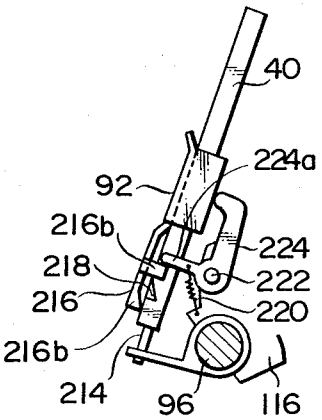

In response to such a movement of the slider 206, the holder frame 92 holding the cassette 40 locked in a predetermined position by the latch pawl 216 is moved from the loaded position of FIG. 15A to the inclined position of FIG. 15C. As the holder frame 92 rotates about the shaft 96 to the intermediate position shown in FIG. 15B, the lug **216*b* of the latch pawl 216 is urged by the arm 224*a* of the stop pawl 224 to resiliently deform to the position of FIG. 15B until its pawl 216*a* becomes clear of the notch 218 of the cassette 40. Then, the cassette 40 is pushed up by the leaf spring 214 to be ejected so that its upper end jumps up through the window 204 as shown in FIG. 12**.

As soon as the holder frame 92 reaches the position of FIG. 15C in which the slider 206 has been fully opened, its cassette holding portion pushes the upper end of the stop pawl 224 and, thereby, rotates it clockwise against the action of the spring 220. Then, the arm **224*a* of the stop pawl 224 is disengaged from the lug 216*b* of the latch pawl 216 so that the pawl 216*a* of the latch pawl 216 is caused into pressing contact with the front end of the cassette 40 due to the resiliency of the latch pawl 216. However, since the cassette 40 has already been pushed up by the spring 214, the pawl 216*a* misses the notch 218 of the cassette 40 and, therefore, allows one to readily pick up the cassette 40 holding the upper end of the cassette 40. Thereafter, when another type wheel cassette 40 is inserted into the apparatus through the window 204 and, after the bottom of the cassette 40 has abutted against the spring 214, depressed deeper into the apparatus to the position shown in FIG. 14, the tip of the pawl 216*a* of the latch pawl 216 fits in the notch 218 of the cassette 40 to lock the cassette 40. Then, as the slider 206 is manually closed, the piece 176 is urged by the lug 212 leftwardly in FIG. 14 to the position of FIG. 15A, whereby the cassette 40** is brought to the predetermined loading position for printing operations.

An arrangement may be made such that the cover open switch (not shown) adapted to open and close in response to opening and closing the top cover 202 opens and closes in unison with the window 204. It will eliminate accidental occurrences such as rotation of the motor 94 or movement of the carriage 90 during the course of replacement of the cassette 40.

Where the window 204 is dimensioned wide enough to admit operator's fingers sufficiently therein, it is possible to pull out the cassette 40 even if the latch pawl 216 and stop pawl 224 are omitted.

Further, the top cover 202 of the apparatus can be opened in order to manually operate the piece 176 whenever desired.

It will be seen from the above that in accordance with the illustrative embodiment it is needless to open and close the top cover 202 of a printer every time the cassette 40 is replaced. Moreover, the manipulation is easy because the cassette is automatically loaded and unloaded in unison with opening and closing of the window 204.

Various modifications will become possible for those skilled in the art after receiving the teachings of the present disclosure without departing from the scope thereof.

What is claimed is:

1. A type wheel cassette loading mechanism in a printing apparatus having a platen, a carriage including cassette holding means movable toward and away from said platen, and a top cover pivotable between a closed position covering said platen and said carriage and an open position allowing access to said platen and said carriage, said type wheel loading mechanism comprising:

an opening in said top cover, said opening having a size sufficient to pass a cassette therethrough and being positioned on said cover such that the cassette passing therethrough may only be introduced into said cassette holding means when said cassette holding means is moved away from said platen;

a lid for selectively closing said opening; and engaging means on said lid and said cassette holding means responsive to the opening of said lid for permitting the cassette to be moved away from said platen and for permitting insertion of said cassette into said cassette holding means.

2. The mechanism as claimed in claim 1 wherein said engaging means comprise an engaging portion of said lid interfittable with an engaging portion of said cassette holding means.

3. The mechanism as claimed in claim 2 including:

spring means for biasing the cassette held by said cassette holding means towards said opening;

means for locking the cassette in said cassette holding means in opposition to said spring means upon insertion of said cassette therein; and means responsive to said movement of said cassette holding means away from said platen for releasing said means for locking.

4. The mechanism as claimed in claim 3 wherein said cassette holding means is pivotally mounted to said carriage adjacent a bottom thereof whereby pivoting of said cassette holding means provides said movement thereof, wherein said means for locking comprises a latch pawl resiliently engaging a cooperating portion of the cassette, and wherein said means for releasing comprise:

a stop pawl pivotally mounted to said carriage and including a latch pawl engaging arm; and resilient means for resiliently pivoting said stop pawl to a position wherein said arm engages said latch pawl, said stop pawl including a portion engageable with said cassette holding means upon movement of said cassette holding means away from said platen for pivoting said stop pawl in opposition to said resilient means, whereby upon said movement of said cassette holding means away from said platen, said arm first disengages said latch pawl from said cooperating portion and subsequent engagement of said portion of said stop pawl and said cassette holding member pivot said stop pawl to release engagement of said arm said latch pawl.

5. A type wheel cassette loading mechanism in a printing apparatus having a platen, a carriage including cassette holding means which is provided with biasing means for biasing a cassette upwardly, and a top cover covering said platen and said carriage, said type wheel cassette loading mechanism comprising:

an opening in said top cover, said opening having a size sufficient to pass the cassette therethrough and being positioned on said cover such that the cassette passing therethrough may only be introduced into said cassette holding means;

a lid for selectively closing said opening;

means for engaging said lid with said cassette holding means such that opening of said lid moves said cassette upwardly by a biasing force of said biasing means; and means responsive to the opening of said lid for permitting said cassette to be moved upwardly by said biasing means, and comprising locking means engageable with the cassette to lock the cassette in a loaded position against an action of said biasing means, and linkage means responsive to the lid being half-opened for disengaging the locking means from the cassette, and said linkage means being responsive to the lid being fully-opened for causing the locking means to regain a position in which the locking means is capable of locking the cassette when the cassette is depressed against the action of the biasing means.

6. A type wheel loading mechanism as claimed in claim 1, wherein said means for engaging comprises an engaging portion provided on an inner surface of the lid, engageable with an engaging portion of the cassette holding means, said engaging portion of the cassette holding means being interlocked therewith such that the cassette is loaded in the cassette holding means when the lid is closed and unloaded from the cassette holding means when the lid is opened.

* * * * *